United States Patent [19]

Franck et al.

[11] 4,180,453

[45] Dec. 25, 1979

[54] PROCESS FOR THE STEAM-CRACKING OF HEAVY FEEDSTOCKS

[75] Inventors: Jean-Pierre Franck, Bougival; Edouard Freund; Jean-François Le Page, both of Rueil Malmaison; Jean Miquel, Paris, all of France

[73] Assignee: Institut Francais du Petrole, Rueil-Malmaison, France

[21] Appl. No.: 876,825

[22] Filed: Feb. 10, 1978

[30] Foreign Application Priority Data

Feb. 11, 1977 [FR] France ..... 77 04151

[51] Int. Cl.[2] ..... C10G 37/00

[52] U.S. Cl. ..... 208/57; 208/89

[58] Field of Search ..... 208/57, 89

[56] References Cited

U.S. PATENT DOCUMENTS

| | | | |
|---|---|---|---|
| 3,394,199 | 7/1968 | Eng et al. | 208/57 |
| 3,511,771 | 5/1970 | Hamner | 208/89 |
| 3,781,195 | 12/1973 | Davis et al. | 208/57 |
| 3,827,969 | 8/1974 | Wilson et al. | 208/89 |
| 3,898,299 | 8/1975 | Jones | 208/57 |
| 4,061,562 | 12/1977 | McKinney et al. | 208/57 |
| 4,065,379 | 12/1977 | Soonawala et al. | 208/57 |

*Primary Examiner*—George Crasanakis

*Attorney, Agent, or Firm*—Millen & White

[57] ABSTRACT

A fresh charge containing aromatic hydrocarbons is hydrotreated in admixture with a recycle fraction, in the presence of a bifunctional catalyst, a portion of the effluent is subjected to steam-cracking, thereby recovering a gas oil fraction which is subjected to hydrogenation and forms said recycle fraction. The mixture of recycle fraction and charge is advantageously treated with hydrogen in the presence of a monofunctional catalyst to hydrogenate olefins, at a lower temperature than the hydrotreatment, and then passed to the hydrotreatment zone.

5 Claims, 1 Drawing Figure

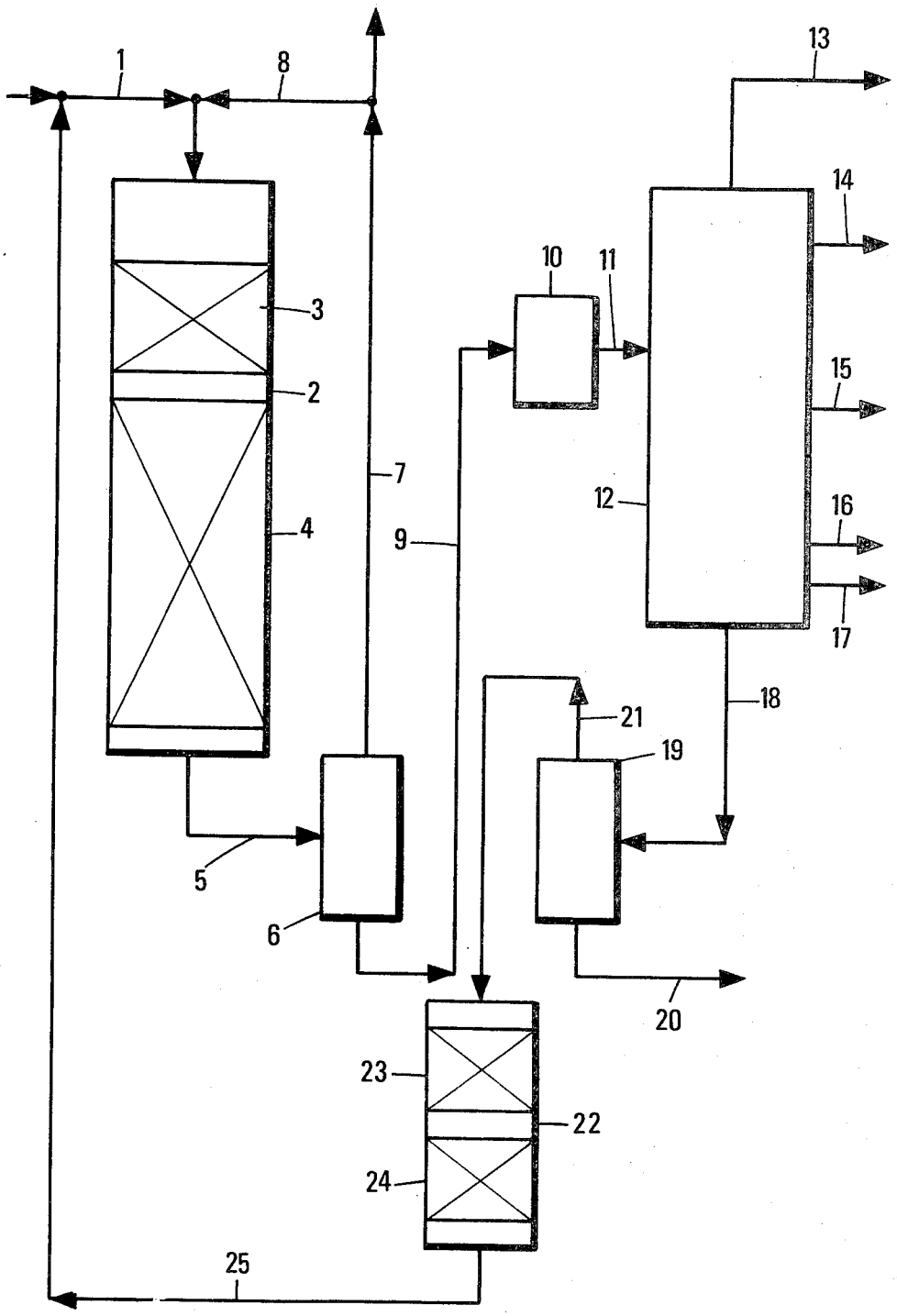
1
8
13
14
10
11
3
2
15
7
12
16
4
9
17
18
21
19
5
6
20
23
22
24
25

PROCESS FOR THE STEAM-CRACKING OF HEAVY FEEDSTOCKS

In view of the high price of the light and heavy gasolines to be used as steam-cracking charges the petrochemists tend more and more to use economically more attractive heavier hydrocarbon cuts, for producing hydrocarbon materials by steam-cracking, i.e. by pyrolysis in the presence of steam. These heavier charges are kerosines and/or gas oils from the atmospheric pressure distillation or even are gas oils from the vacuum distillation or deasphalted residues. These charges, whose initial boiling point is usually higher than about 150° C., have often the disadvantage to contain, depending on their origin, mono- or, above all, polyaromatic hydrocarbons, and their use as steam-cracking charges is a problem, particularly when these charges contain more than 10% b.w. of mono and/or polyaromatic hydrocarbons. The advantage of price of such charges is thus partially balanced by a number of disadvantages when the charge to be pyrolyzed is used as such; these disadvantages include: a poor ethylene yield by weight, a too high conversion to heavy products (200° C.+) which cannot be upgraded easily, and fast coking of the pyrolysis furnaces. These disadvantages may be reduced to a large extent by coupling a catalytic pretreatment to steam-cracking, according to a process scheme which is the object of the present invention.

According to the scheme of the present invention, illustrated in FIG. 1, the charge, of initial boiling point higher than about 150° C. A.S.T.M., and which comprises at least 10% b.w. of mono or polyaromatic hydrocarbons, prior to steam-cracking, is first treated in the presence of hydrogen under such conditions that not only the nitrogen and sulfur containing heteroatomic molecules are made largely free of nitrogen and sulfur, not only the monocyclic aromatic molecules are largely hydrogenated with production of the corresponding naphthenes, but also the polycyclic aromatics are either hydrogenated or partly decyclohydrogenated to partially or totally hydrogenated monocyclic molecules. The catalyst used in this catalytic hydrotreatment is a bifunctional catalyst with a hydrogenation function and an acid function, the latter being responsible of the desired decyclohydrogenation; the hydrogenation function is supplied by at least one sulfide of the metals of group VI.B of the periodic classification of the elements (for example tungsten and/or molybdenum), said sulfide being optionally promoted with at least one sulfide of the metals of group VIII, for example cobalt, or advantageously nickel, in the present case where thorough hydrogenation of the starting charge is desired. The catalyst contains 1–30% b.w. of at least one group VI B metal sulfide and preferably 5–30% b.w. of at least one group VI B metal sulfide and optionally 1–15% b.w. of at least one group VIII metal sulfide, for example cobalt or nickel. The acid function is supplied, for example, either from alumina of high purity and high specific surface, for example higher than 200 $m^2/g$, or better, from alumina-silica containing 10–50% b.w. of $SiO_2$, or from alumina-boron whose boron oxide content is between 5 and 50% b.w., or from fluorinated alumina whose fluorine content by weight is between 0.5 and 5% and advantageously between 1 and 3%, or alternatively from magnesia-silica.

The operating conditions of the treatment are preferably as follows: Total pressure: 70–130 bars, L.H.S.V.: 0.5–2; $P_{H2}$: 60–120 bars; T: 340°–420° C.

The steam-cracking reaction is effected conventionally at a temperature from 600° to 950° C. and at a pressure of, for example, 0.5 to 2 bars.

According to the process of the invention, a fraction of the gas-oil recovered from the steam-cracking is recycled to the prior hydrotreatment. This fraction is selected in the distillation range of about 150°–400° C., preferably of 200°–350° C. This recycle gas-oil (consisting essentially of alkenylaromatic hydrocarbons and bi- or polycyclic aromatic hydrocarbons, also substituted with methyl, ethyl or alkenyl groups, such as ethenyl naphthalenes or indene) cannot be pyrolyzed in the presence of steam (by mere direct recycle to the pyrolysis or steam-cracking zone), even when admixed with straight-run gas oil, when not subjected to a prior treatment.

Conversely, when the fresh charge and said recycle gas-oil fraction are together subjected to the above-mentioned hydrotreatment, it is found that not only nearly all olefinic and aromatic hydrocarbons hydrogenate, but also a substantial decyclization of the polycyclic or monocyclic hydrocarbons occurs, so that the polycyclic hydrocarbon content of the total hydrotreatment feed (mixture of the fresh charge with recycle gas-oil) may be brought back to the initial content in the fresh charge or to a lower value.

But, according to the process of the invention, it is necessary, in order to effect a judicious and effective pretreatment, on the one hand, to recycle at least a gas oil fraction discharged from the steam-cracking, amounting to at least 6% b.w. with respect to the initial charge, and on the other hand, to subject the recycle gas oil fraction to the hydrogenation stage before its hydrotreatment. This hydrogenation is conducted in a reactor operated at low temperature, with a suitable catalyst, in order to eliminate the highly unsaturated products which would tend to polymerize in the hydrotreatment reactor, in the exchanges and in the furnace of the hydrotreatment unit, which are operated at high pressure and temperature. This prior hydrogenation is the more necessary as the recycle products are obtained from high severity steam-cracking for a high ethylene production.

According to the process of the present invention, this hydrogenation of the recycle fraction is effected at a temperature of 150° to 260° C., a pressure of 30 to 130 bars, a L.H.S.V. of 1 to 5, preferably 1.5 to 3, with a catalyst containing palladium or another noble metal of the platinum family (0.2 to 1% b.w.) or containing at least one sulfide of a metal from groups VI B or VIII, such as nickel, molybdenum or tungsten, for example, 1–30% b.w. of such sulfide or mixture of sulfides, for example nickel and molybdenum (Ni-Mo) or nickel and tungsten (Ni-W). The carrier of this catalyst is a neutral carrier of silica or alumina type having a low specific surface (10–100 $m^2/g$). After this hydrogenation, the alkenyl aromatic and indene content of the recycle fraction is lower than 1% b.w. The hydrogenated fraction which is supplied as a mixture with the fresh hydrocarbon charge, represents at least 10% b.w. of this fresh charge and preferably about 15% b.w. of said fresh charge.

As compared to a steam-cracking process with mere pretreatment without gas oil recycle, the process of the invention makes it possible to increase by about 15% the ethylene yield with respect to the charge, by about 20% the yield of aromatic hydrocarbons having 6, 7 and 8 carbon atoms per molecule, while decreasing the content of undesirable products, i.e. heavy products (200° C.+ fraction), particularly the very heavy products (350° C.+), while increasing the cycle period by reduction of the coking rate in the pyrolysis tubes.

According to the process of the present invention, it is advantageous to have the bed of bifunctional hydrotreatment catalyst preceded with a bed of monofunctional catalyst, non-acid or of very low acidity and having only hydrogenation activity, so as to discard the olefins which could also polymerize and coke the decyclohydrogenation catalyst, i.e. the hydrotreatment catalyst. With such an arrangement, each cycle between two regenerations may be three times longer. The catalyst proposed for this first catalyst bed contains at least one sulfide of a metal from groups VI B and VIII of the periodic classification of the elements, preferably a nickel or molybdenum, or nickel or tungsten sulfide; the catalyst preferably contains either nickel and molybdenum sulfides or nickel and tungsten sulfides. The group VIII metal sulfide content by weight is between 2 and 12% and advantageously between 6 and 9%, and the group VI B metal sulfide content by weight is between 8 and 20%, preferably between 12 and 15%. The carrier is usually alumina or silica of low acidity or neutral.

The acidity of the carrier may be measured by the heat of ammonia adsorption on the carrier at a pressure of $10^{-4}$ mm Hg. The heat of adsorption ΔH is expressed as:

$$\Delta H = \frac{\text{Released heat (in calories per gram of carrier)}}{\text{Amount of adsorbed ammonia (in millimole } NH_3 \text{ per gram of carrier)}}$$

These two determinations are conducted by microgravimetry and differential thermal analysis at the temperature of use of the catalyst.

A carrier may be considered as substantially neutral when its ΔH is lower than 0.04 and slightly acid when it is between 0.04 and 0.1.

In the present case, the acidity of the carrier is preferably lower than 0.06. In the first bed, the temperature is between 280° and 400° C. and also lower than that of the second catalyst bed of the hydrotreatment zone; it is preferably lower by about 20°-60° C. than the temperature of the second bed. It is operated in the presence of hydrogen, the various operating conditions, except temperature, being defined as for the hydrotreatment zone.

The process of the invention is illustrated by FIG. 1. The arrangement permits to substantially increase the yield of desired product, i.e. ethylene, propylene, aromatic hydrocarbons having 6, 7 and 8 carbon atoms per molecule, while reducing the content of undesired products, i.e. pyrolysis gas oils.

The charge is supplied through duct 1 into the hydrotreatment zone 2, which may optionally contain a first catalyst bed 3, and which contains a second catalyst bed 4. The outflow is discharged through duct 5; it passes through an adequate separation zone 6, wherefrom are discharged, through duct 7, a light fraction (for example hydrogen, methane) (a portion of which may be recycled to zone 2 through duct 8), and, through duct 9, an effluent; at least a portion of the latter passes through several conventional zones, for example pyrolysis, quench or compression zones (schematized as zone 10) and is delivered through duct 11 to the steam-cracking zone 12. Distinct fractions are discharged from the steam-cracking zone 12, for example:

- -through duct 13, light products such as hydrogen, carbon monoxide and methane.
- -through duct 14, light hydrocarbons such as ethane and ethylene.
- -through duct 15, products such as propane and propylene.
- -through duct 16, various hydrocarbons containing 4 carbon atoms per molecule (butane, butenes, butadiene).
- -through duct 17, a gasoline fraction.
- -through duct 18, gas oil.

At least a portion of this gas oil of duct 18 is passed through a separation zone 19 for eliminating residues through duct 20; it is then fed through duct 21 into a hydrogenation zone 22 which comprises two catalyst beds 23 and 24. The so-hydrogenated product is recycled to the hydrotreatment zone 2 through duct 25.

EXAMPLE 1 (comparison)

In a pyrolysis microoven, there is treated, in a first run, a fresh hydrocarbon charge consisting of a 170°-310° C. (A.S.T.M. distillation) atmospheric distillation cut (gas oil) whose composition by weight, as hydrocarbon groups, is given in the following Table I:

TABLE I

| | | |
|---|---|---|
| Paraffins + isoparaffins | 54 | % by weight |
| Naphthenes | 24 | % by weight |
| Monocyclic aromatics (alkyl-benzenes) | 12 | 22% by weight |
| Bicyclic aromatics | 6 | |
| Aromatic naphthenes | 4 | |

The laboratory reactor used as the micro-oven consists of a steel pipe of the Incoloy 800 type, of 4 mm internal diameter and operated isothermally. The pipe is coiled around a graphite cylinder which ensures proper isothermicity of the system, and heating is conducted in an induction oven which reaches very quicly the temperatures required for the conversion; quenching is obtained at the pipe outlet by water cooling. The residence time of the mixture of hydrocarbon with water is 0.2 second and the temperature 830° C.

The yields of the key products, i.e. the highly upgradable products (ethylene, propylene, butadiene, $C_6$, $C_7$ and $C_8$ aromatics) or the undesirable products (methane and 200° C.+ cut) are determined. The yields are given in Table II (column 1).

In a second run, the gas oil charge whose specifications are given in Table I has been previously hydrotreated with a catalyst named "catalyst A" containing 6% $Ni_3S_2$ and 28% $WS_2$ carried on alumina-silica of 20% $SiO_2$ content, in the following operating conditions:

- -P = 100 bars
- -$P_{H2}$ = 80 bars
- -L.H.S.V. = 1.2
- -T = 380° C.

At the end of the hydrotreatment, the aromatic hydrocarbon content was lower than 2% by weight and the content of polycyclic molecules lower than 0.5%. At the end of this pretreatment, the products condensed at 0° C. (yield: 99.8%) were pyrolyzed in the presence of steam at 830° C., the residence time being 0.2 second. The resulting products had the distribution given in Table II (column 2).

TABLE II

| PRODUCTS | Yields in % b.w.(*) without prior hydrotreatment | Yields in % b.w.(*) with prior hydrotreatment |
|---|---|---|
| hydrogen | 0.60 | 0.80 |
| ethylene | 22.76 | 25.66 |
| propylene | 14.00 | 15.80 |
| butadiene | 4.82 | 4.91 |
| aromatics ($C_6 + C_7 + C_8$) | 10.06 | 13.72 |
| methane | 12.52 | 12.80 |
| 200–350° C. cut | 12.11 | 7.45 |
| residues (350° C.+) | 7.01 | 3.12 |
| various others | 16.12 | 15.74 |

(*)Yields for 100 kg of fresh charge fed to pyrolysis in the presence of steam.

EXAMPLE 2

In a second series of experiments, the second part of example 1 is repeated (the experiment with hydrotreatment); however the whole gas oil fraction (200°–350° C.) from the pyrolysis step is recycled. This fraction has the composition stated in Table III and represents (see Table II, right column) 7.45% b.w. of the fresh hydrocarbon charge.

TABLE III

| Composition by family of the 200–350° C. gas oil fraction returned to the prior hydrotreatment | % by weight |
|---|---|
| Monocyclic aromatics (including alkenyl benzenes) | 10 |
| Bicyclic aromatics | 45 |
| Tricyclic aromatics | 17 |
| Condensed aromatic naphthenes (including indenes) | 28 |

The highly unsaturated compounds are first removed by hydrogenation from this recycle gas oil. This hydrogenation is conducted at 200° C. under a pressure of 30 bars, in the presence of a catalyst containing 0.4% of palladium deposited on a 50 $m^2/g$ alumina carrier. The hydrogenated gas oil is then mixed with the charge of straight-run gas oil of Table I in a proportion of 15% b.w., and the mixture is treated at 120 bars of total pressure at a $H_2/HC$ ratio of 1,000 in liters of hydrogen gas N.T.P. (i.e. at normal temperature and pressure) per liter of liquid hydrocarbon mixture, and at a space velocity of 1, on two catalyst beds. The first bed amounts to one fourth of the reactor volume; it contains a catalyst containing 8% $Ni_3S_2$ and 15% $MoS_2$ deposited on transition alumina previously impregnated with nickel and roasted to 850° C. to form superficial nickel aluminate which reduces the surface acidity of the starting alumina. The final catalyst has a surface of 145 $m^2/g$ and a $\Delta H$ of 0.02. The second catalyst bed contains the same catalyst A as that described in example 1. The first bed is operated at 350° C., the second one at 380° C. The composition of the mixture, after hydrotreatment, is given in the left side of Table IV. The mixture is then subjected to pyrolysis in the above conditions at 830° C. and with a residence time of 0.2 second; it gives the yields of key products reported in Table V (column 2).

EXAMPLE 3

The conditions of example 3 are identical to those of experiment 2, except that the proper hydrotreatment catalyst, i.e. that of the second bed, is changed: it contains 5% $Ni_3S_2$ and 18% $MoS_2$ deposited on alumina-boron of 16% boron content ($B_2O_3$) with respect to the sum $B_2O_3+Al_2O_3$ (catalyst B). The product obtained at the end of the hydrotreatment can be compared to that obtained in example 2, as shown on the right side of Table IV (the lower part of Table IV gives the detailed composition by family of the "200° C.-final point" fraction). The so-hydrotreated product is then pyrolyzed under the conditions stated above, at 830° C. (residence time: 0.2 second); the yields of Table V, column 3, are obtained; they compare to those of the preceding example (Table V, column 2) with catalyst A.

TABLE IV

Composition of the product obtained after hydrotreatment of the mixture of 85% by weight of straight-run gas oil and 15% by weight of recycled and hydrogenated gas oil.

| WITH CATALYST A | % BY WEIGHT | WITH CATALYST B | % BY WEIGHT |
|---|---|---|---|
| $C_1 + C_2$ | 0.5 | $C_1 + C_2$ | 0.8 |
| $C_3 + C_4$ | 1.1 | $C_3 + C_4$ | 1.3 |
| $C_5 - 200$ | 4.3 | $C_5 - 200$ | 5.4 |
| 200–Final point (330° C.) | 94.1 | 200–Final point (330° C.) | 92.5 |
| Composition by family of the 200° C.-final point fraction | | | |
| n-paraffins + iso-paraffins | 50 | n-paraffins + iso-paraffins | 49 |
| naphthenes | 44 | naphthenes | 46 |
| aromatic naphthenes | 3.5 | aromatic naphthenes | 2.6 |
| aromatics | 2.5 | aromatics | 2.4 |

TABLE V

| | Composition of the product hydrotreated on catalyst A after pyrolysis. % by weight (*) | Composition of the product hydrotreated on catalyst B after pyrolysis % by weight (*) |
|---|---|---|
| hydrogen | 0.78 | 0.79 |
| ethylene | 23.81 | 24.05 |
| propylene | 14.90 | 14.83 |
| butadiene | 4.30 | 3.90 |
| aromatics ($C_6 + C_7 + C_8$) | 15.27 | 14.96 |
| methane | 13.02 | 14.07 |
| 200–350° C. cut | 9.80 | 8.90 |
| residue (350° C.+) | 4.50 | 4.20 |
| various others | 13.62 | 14.30 |

(*)for 100 kg of hydrotreated products fed to the pyrolysis in the presence of steam.

In Table V (results with hydrotreatment and recycling of a hydrogenated gas oil fraction), the ethylene, propylene and $C_6$, $C_7$ and $C_8$ aromatics appear to be of the same order of magnitude as in Table II, right column (results with hydrotreatment, but without recycling of a gas oil fraction). It may be noted that:

- on the one hand, in Table V, the yields must be increased by 15% to be comparable with those of Table II since, in Table V, the charge subjected to hydrotreatment contains 15% of recycle gas oil and 85% of fresh charge (100% of fresh charge in Table II),
- on the other hand, in Table V, 9.8% or 8.9% b.w. of a 200°–350° C. cut is obtained (depending on whether catalyst A or B is used); the latter will be, according to the invention, recycled to the hydrotreatment stage and again to the pyrolysis stage to be converted in substantial proportion to ethylene, propylene and $C_6$, $C_7$ and $C_8$ aromatics.

What we claim is:

1. A process for treating a hydrocarbon charge of initial boiling point higher than about 150° C., selected from the atmospheric gas oils, vacuum gas oils and deasphalted residues, the charge containing at least 10% by weight selected from monocyclic and polycyclic aromatic hydrocarbons, comprising the steps of:

(a) passing a mixture of said hydrocarbon charge with a recycle fraction as hereinafter defined through a catalyst bed in the presence of hydrogen to hydrogenate olefins present in said mixture, at a temperature between 280° and 400° C., said temperature being lower than the hydrotreating of step (b), said catalyst bed containing at least one sulfide of a metal from group VI B and at least one sulfide of a metal from group VIII of the periodic classification of the elements, and a carrier having an acidity corresponding to a heat of ammonia absorption lower than $\Delta H=0.06$, measured at a pressure of $10^{-4}$ mm Hg;

(b) subjecting resultant effluent from step (a) to a hydrotreatment to separate nitrogen and sulfur and to hydrogenate the monocyclic and polycyclic aromatic hydrocarbons therein, at 340°-420° C., in the presence of hydrogen gas and a catalyst comprising 1-30% by weight of at least one sulfide of a metal selected from tungsten and molybdenum, and at least one sulfide of a metal selected from cobalt and nickel, and an acidic carrier selected from aluminas, alumina-silicas, boron-aluminas, fluorinated aluminas and magnesia-silicas;

(c) subjecting at least a portion of resultant effluent from the hydrotreatment of step (b) to a steam-cracking step;

(d) withdrawing from the steam-cracking step a gas oil fraction distilling at about 150°-400° C., light hydrocarbons and a gasoline fraction;

(e) subjecting at least a portion of said gas oil fraction from step (d) to hydrogenation at 150°-260° C. under a pressure of 30 to 130 bars, at a L.H.S.V. of from 1 to 5, in the presence of a catalyst selected from a platinum group metal or at least one sulfided metal from group VI B and VIII of the periodic classification of elements, and a carrier selected from the group consisting of alumina and silica having a specific surface of between 10 and 100 $m^2/g$, said hydrogenation effecting a decrease of the total content of alkenylaromatic hydrocarbons and indenes in said gas oil fraction to less than 1% by weight; and (f) admixing resultant effluent from step (e) as said recycle fraction with said hydrocarbon charge to form said mixture which is passed through said catalyst bed of step (a), the amount of said admixed recycle fraction being at least 10% by weight of said hydrocarbon charge.

2. A process according to claim 1, wherein the hydrotreatment catalyst in step (b) contains 5-30% by weight of at least one sulfide of a metal selected from tungsten and molybdenum and 1-15% by weight of at least one sulfide of a metal selected from cobalt and nickel.

3. A process according to claim 1, wherein the catalyst bed in step (a) contains 2-12% by weight of nickel sulfide and 8-20% by weight of molybdenum or tungsten sulfide.

4. A process according to claim 1, wherein the amount of said recycle fraction admixed in step (f) is about 15% of said hydrocarbon charge.

5. A process according to claim 1, wherein the temperature of the catalyst bed of step (a) is lower by 20° to 60° C. than the hydrotreatment temperature of step (b).

* * * * *